US005928070A

United States Patent [19]

Lux

[11] Patent Number: 5,928,070

[45] **Date of Patent: *Jul. 27, 1999**

[54] ABRASIVE ARTICLE COMPRISING MULLITE

[75] Inventor: Ronald Eugene Lux, White Bear Lake, Minn.

[73] Assignee: Minnesota Mining & Manufacturing Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/866,285

[22] Filed: May 30, 1997

[51] Int. Cl.[6] ..... B24D 11/00

[52] U.S. Cl. ..... 451/526; 451/536; 51/307

[58] Field of Search ..... 451/532, 526, 451/533, 538, 539, 534, 536; 51/307, 296, 309

[56] References Cited

U.S. PATENT DOCUMENTS

| | | | |
|---|---|---|---|
| 2,284,716 | 6/1942 | Benner et al. | 451/532 |
| 2,284,738 | 6/1942 | Hurst | 451/532 |
| 2,309,819 | 2/1943 | Benner | 451/532 |
| 2,334,572 | 11/1943 | Melton et al. | 451/532 |
| 2,404,207 | 7/1946 | Ball | 451/532 |
| 2,958,593 | 11/1960 | Hoover et al. . | |
| 3,260,582 | 7/1966 | Zimmer, Jr. et al. | 451/532 |
| 3,284,963 | 11/1966 | Lanham et al. | 451/532 |
| 3,324,609 | 6/1967 | Stein et al. | 451/532 |
| 3,789,050 | 1/1974 | Domingo . | |
| 3,972,394 | 8/1976 | Jacko et al. . | |
| 4,227,350 | 10/1980 | Fitzer . | |
| 4,355,489 | 10/1982 | Heyer et al. | 451/532 |
| 4,414,199 | 11/1983 | Strobridge . | |
| 4,437,271 | 3/1984 | McAvoy | 451/532 |
| 4,486,200 | 12/1984 | Heyer et al. . | |
| 4,848,041 | 7/1989 | Kruschke . | |
| 4,910,924 | 3/1990 | Holden et al. . | |
| 5,035,723 | 7/1991 | Kalinowski et al. . | |
| 5,095,665 | 3/1992 | Nagata et al. | 51/307 |
| 5,103,598 | 4/1992 | Kelly . | |
| 5,118,326 | 6/1992 | Lee et al. . | |
| 5,129,919 | 7/1992 | Kalinowski et al. . | |
| 5,131,926 | 7/1992 | Rostoker et al. . | |
| 5,152,809 | 10/1992 | Mattesky . | |
| 5,185,012 | 2/1993 | Kelly . | |
| 5,194,072 | 3/1993 | Rue et al. . | |
| 5,203,886 | 4/1993 | Sheldon et al. . | |
| 5,244,477 | 9/1993 | Rue et al. . | |
| 5,339,931 | 8/1994 | Jacko et al. . | |
| 5,366,524 | 11/1994 | Holcombe, Jr. et al. . | |
| 5,472,461 | 12/1995 | Li . | |
| 5,626,512 | 5/1997 | Palaikis et al. | 451/532 |
| 5,679,067 | 10/1997 | Johnson et al. | 451/527 |
| 5,711,774 | 1/1998 | Sheldon | 51/307 |
| 5,712,210 | 1/1998 | Windisch et al. | 451/532 |

FOREIGN PATENT DOCUMENTS

WO 96/33638 10/1996 WIPO .

OTHER PUBLICATIONS

"Synthetic Mullite Refractories' Shock Absorber"; IM Refractories Survey 1993.

"Duramul RF Splits"; Washington Mills Electro Minerals Corporation.

"Magnesia Alumina Spinels for the Refractory Industry"; Elfusa Geral de Eletrofusao Ltda; Jun. 1993.

"American National Standard for Grading of Certain Abrasive Grain on Coated Abrasive Material"; American National Standards Institute; Jan. 27, 1984; 26 pages.

*Primary Examiner*—Timothy V. Eley
*Assistant Examiner*—Derris Holt Banks
*Attorney, Agent, or Firm*—Paul W. Busse

[57] ABSTRACT

A low-density abrasive article comprising a nonwoven web and a multiplicity of abrasive particles which are bonded to the nonwoven web by means of an adherent binder. Abrasive particles useful in the present invention have particle sizes between about grade 4 to grade 36 and are made of an abrasive mineral having a Mohs hardness of less than about 8. The abrasive particles are preferably made of synthetically manufactured fused mullite. The low density abrasive article is particularly suitable for removing stock from a carbon steel workpiece.

24 Claims, 1 Drawing Sheet

ABRASIVE ARTICLE COMPRISING MULLITE

BACKGROUND

The present invention relates to a low-density abrasive article employing an open, porous, lofty nonwoven web containing a multitude of abrasive particles bonded thereto and particularly to an abrasive article containing fused mullite abrasive particles.

Abrasive articles come in many types, each generally designed for specific applications and no one type providing a universal abrading article for all applications. The various types of abrading articles include, for example, coated abrasive articles, i.e. abrasive particles generally uniformly distributed over and adhered to the surface of a flexible backing; grinding wheels, i.e. abrasive material consolidated together in a mass in the form of a rotatable annulus; and low-density abrasive articles, i.e. open, porous, lofty, nonwoven webs impregnated with adhesive which does not alter the open character of the web and also bonds abrasive particles to the web.

Low-density abrasive articles have enjoyed considerable commercial success as metal, wood, and plastic finishing tools. Low-density abrasive articles typically consist of open, porous, lofty nonwoven webs made of either autogenously bonded continuous undulated interengaged filaments or randomly oriented high strength fibers. The nonwoven webs are impregnated with a binder which adhesively bonds the filaments or fibers of the web together and also adhesively bonds a multitude of abrasive particles to the surface of the filaments or fibers. One very successful commercial embodiment of such an abrasive article is that sold under the trade designation "Clean-N-Strip" by Minnesota Mining and Manufacturing Company of St. Paul, Minn.

Low-density abrasive articles of this type may be prepared by the method disclosed by Fitzer in U.S. Pat. No. 4,227,350. The nonwoven web of Fitzer is comprised of continuous undulated interengaged filaments which are autogenously bonded at points of mutual contact. An adherent binder bonds the filaments together and also bonds a multitude of abrasive particles uniformly distributed throughout the nonwoven web, to the surface of the filaments. The abrasive particles may be of any known abrasive material commonly used in the abrasive art having a particle size from grade 10 to grade 600 and a Mohs hardness from 4 to 10.

Although the commercial success of low-density abrasive articles has been impressive, it is desirable to expand their range of performance. Due to their low cutting rates, low-density abrasive articles have not generally been found useful for the removal of a large amount of material or stock from a workpiece, such as for the removal of stock from a carbon steel workpiece. Heretofore, low-density abrasive articles of the type described in Fitzer have been used primarily for the process of surface conditioning, or cleaning of substrates, such as the removal of oxides from surfaces prior to painting.

Because of their higher cut rate, coated abrasive articles have generally been preferred over low-density abrasive articles for the removal of stock from a workpiece. The use of coated abrasive articles is not without disadvantage, however. For example, the use of coated abrasive articles to abrade a workpiece can result in the generation of a significant amount of heat on the surface of the workpiece. This creates the potential to impart scorch marks on the workpiece, which may have to be removed in a subsequent abrading step. In the process of removing surface coatings from a workpiece, the heat generated by coated abrasive articles may cause the surface coating to soften and to be smeared over the surface of the workpiece. The softened coating may also transfer more easily from the workpiece to the coated abrasive article, causing the coated abrasive article to clog or "load" and resulting in a reduction in its useful life.

It is well known that low-density abrasive articles generate less heat during use than coated abrasive articles, due to their open, porous, lofty nonwoven web which permits a degree of cooling. In order to increase the cut rate of a low-density abrasive article a person skilled in the art might be expected to select large particles of well known abrasive minerals, such as $Al_2O_3$ or SiC. It has been observed, however, that when certain abrasive minerals, such as $Al_2O_3$, are used to abrade carbon steel workpieces, a maximum cut rate is reached beyond which an increase in abrasive particle size does not substantially increase the cut rate of the low-density abrasive article. In addition, it has been observed that on carbon steel workpieces, certain abrasive minerals, such as SiC, when used in a low-density abrasive are ineffective at producing even a moderate cut rate, regardless of abrasive particle size.

In light of the foregoing, it would be desirable to provide an abrasive article which has a high cut rate on substrates, such as carbon steel, yet retains the properties of a nonwoven abrasive such as the reduced tendency to generate heat on the surface of the workpiece being abraded. Moreover, it is desirable to provide such an article using an inexpensive abrasive mineral.

SUMMARY

The present invention provides a nonwoven abrasive article which has a cut rate on carbon steel that is comparable with a coated abrasive article and provides the advantages of a nonwoven abrasive article, such as a reduced tendency to generate heat on the surface of a workpiece during use. The present invention is also useful for removing surface coatings from substrates.

An abrasive article of the present invention comprises a nonwoven web and a multiplicity of abrasive particles which are bonded to the nonwoven web with a binder. In the preferred embodiment the open, porous, lofty, nonwoven web is either a continuous filament nonwoven web or a staple fiber nonwoven web. A continuous filament web comprises a multitude of continuous undulated interengaged filaments of high strength thermoplastic polymeric material. The filaments are autogenously bonded at points of mutual contact. A staple fiber web comprises a multitude of randomly oriented high strength fibers. The fibers are adhesively bonded at points of mutual contact. The outermost segments of the nonwoven web filaments define relatively planar first and second major web surfaces. The first major web surface is the working surface of the abrasive article and abrasive particles are dispersed in a relatively uniform fashion across the first major web surface. The abrasive particles are non-uniformly distributed throughout the nonwoven web.

The abrasive particles useful in the present invention comprise a relatively soft abrasive mineral, having a Mohs hardness of less than about 8. Abrasive particles useful in the present invention are relatively large, having a particle size between about grade 4 to about grade 36. The abrasive particles are preferably made of the synthetically manufactured fused mullite. When used in an abrasive article according to the present invention, fused mullite abrasive particles have been found quite unexpectedly to provide a high cut rate on carbon steel substrates. Furthermore, fused mullite abrasive particles are an inexpensive abrasive particle being priced at approximately 10% of the cost of conventional abrasive particles. This makes low-density abrasive articles according to the present invention more cost competitive with other types of abrasive articles.

The present abrasive article is used for removing material from the surface of a workpiece by manually pressing the abrasive article against the workpiece and rapidly moving it relative to the workpiece while maintaining pressure between the abrasive article and the workpiece. In this aspect of the invention the abrasive article is preferably provided in the form of a disc adapted to be attached to a motorized abrading device, such as a right angle grinder or drill. The preferred means for attachment of the disc to the motorized abrading device is by a "hook-and-loop" fastening system, or a pressure sensitive adhesive.

Certain terms are used in the description and the claims will be understood to have the following meanings. "Binder" refers to a coatable hardenable composition applied to the nonwoven web in order to adhesively bond the abrasive particles thereto and in order to bond the filaments making up the nonwoven web to one another. The binder applied prior to addition of the abrasive particles is referred to as a "make coat." The binder applied subsequent to the addition of the abrasive particles is referred to as a "size coat." "Carbon steel" means a metal alloy containing iron as the major component and small amounts of carbon (0.25% to 0.7%) as the major alloying element. Small amounts of other elements such as manganese, silicon, chromium, molybdenum, and nickel may also be present in carbon steel. "Cut on 1018 carbon steel" means the weight in grams of 1018 carbon steel removed by an abrasive article when the abrasive article is used as described in Slide Action Test described herein. "Filament" means a threadlike structure comprising any of the materials described herein. "Mohs Hardness" is a scale which may be used to compare the hardness of a abrasive particles. The scale ranges from 1 (softest) to 10 (hardest) with diamond having a hardness number of 10 and talc having a hardness number of 1. "Mullite" refers to the naturally occurring or synthetically manufactured orthorhombic mineral comprising by weight about 75% $Al_2O_3$ and about 25% $SiO_2$.

Further details of the invention will be appreciated by those skilled in the art upon consideration of the remainder of the disclosure, including the detailed description of the preferred embodiment and the appended claims.

BRIEF DESCRIPTION OF THE DRAWINGS

The present invention will become better understood with regard to the following description, appended claims, and accompanying drawings.

DETAILED DESCRIPTION

Figure 1:
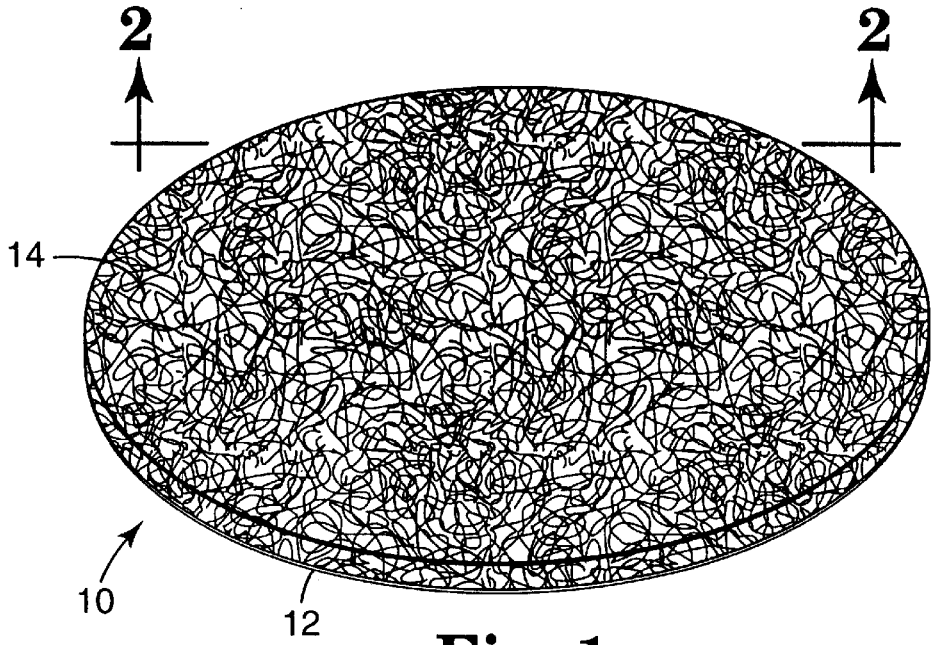
FIG. 1 is a perspective view illustrating an abrasive article made in accordance with the present invention.

FIG. 1 illustrates an abrasive article 10 in the form of a disc. Disc 10 includes a backing 12, an open, porous, lofty, nonwoven web 14, and a multiplicity of abrasive particles which are adhered to the nonwoven web by means of an adherent binder (not shown).

Figure 2:
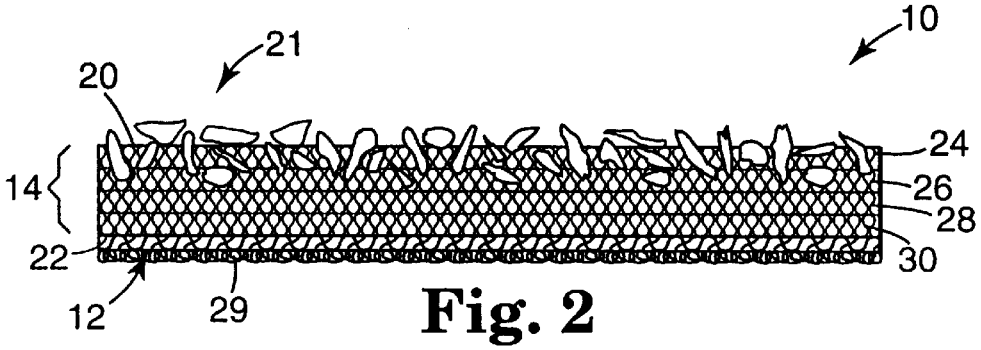
FIG. 2 is an enlarged side elevational view of the abrasive article depicted in FIG. 1 taken at line 2—2 of FIG. 1.

FIG. 2 is a cross-sectional view of abrasive article 10. The open, porous, lofty, nonwoven web 14 is affixed to the backing 12. The nonwoven web 14 can be either a continuous filament nonwoven web of the type described by Fitzer in U.S. Pat. No. 4,227,350 incorporated herein by reference, or may be a staple fiber nonwoven web of the type described by Hoover et al. in U.S. Pat. No. 2,958,593 incorporated herein by reference. A continuous filament nonwoven web consists of multiple rows, four of which are shown as 24, 26, 28, and 30, of continuous undulated interengaged filaments of high strength filament forming thermoplastic polymeric material. Adjacent filaments are autogenously bonded at points of mutual contact. The nonwoven web comprises a first major web surface 20 and second major web surface 22. The first major web surface 20 forms the working surface of the abrasive article 10. A multitude of abrasive particles 21 are dispersed in a relatively uniform fashion across the first major surface 20 of the nonwoven web and are bonded to the filaments of the nonwoven web by means of an adherent binder (not shown). The abrasive particles 21 are non-uniformly distributed between the first major web surface 20 and the second major web surface 22 with a high concentration of abrasive particles being bonded to filaments of the nonwoven web located proximate the first major web surface 20. Backing 12 is bonded to the second major web surface 22 of the nonwoven web 14. Backing 12 provides means for attaching abrasive article 10 to a motorized abrading device, such as a right angle grinder. Backing 12 is a fabric having deployed thereon a plurality of loops 29 which are suitable for attachment to an abrasive back-up pad which contains a plurality of hooks. Alternatively, backing 12 may consist of a pressure sensitive adhesive of a type suitable for attachment to an abrasive back-up pad.

Figure 3:
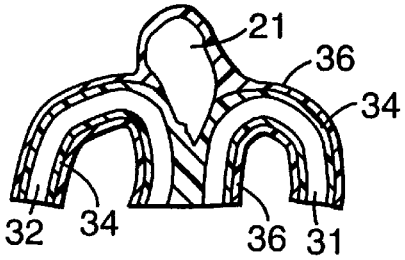
FIG. 3 is an enlarged view of filaments of the nonwoven web detailing the bonding of an abrasive particle to the nonwoven web.

FIG. 3, illustrates the bonding of an abrasive particle 21 to filaments 31 and 32 of the nonwoven web 14 shown in FIG. 2. The abrasive particle 21 is adhesively bonded to the two filaments 31 and 32 by means of two coatings of binder. The first coating of binder, which is applied prior to the addition of the abrasive particles, is termed a make coat 34. The make coat functions to bond the individual filaments 31 and 32 of nonwoven web 14 to one another and further functions to bond the abrasive particle 21 to the filaments 31 and 32 of the nonwoven web. The second coating of binder is termed a size coat 36 and is applied subsequent to the addition of the abrasive particles. The size coat function to bond the abrasive particles 21 to the filaments 31 and 32 of the nonwoven web. The size coat also provides additional bonding between individual filaments 31 and 32 of the nonwoven web. The make coat 34 and size coat 36 provide a substantially continuous coating over the surface of the filaments of nonwoven web 14 and the abrasive particles 21.

Manufacturing Procedure

The abrasive article 10 is manufactured by first forming the nonwoven web 14. Once formed, the nonwoven web 14, being either a continuous filament nonwoven web or a staple fiber nonwoven web, is passed through a coating station where a first coat of binder or make coat 34 is applied. Any conventional web coating technique such as dip coating, roll coating, and spray coating may be employed to coat the nonwoven web so long as it provides a substantially uniform coating. The make coat should be sufficient to permit coating the nonwoven web with a multiplicity of abrasive particles 21. After coating the make coat, the coated nonwoven web is then passed beneath an abrasive particle dropping station where a multiplicity of abrasive particles are applied to the first major surface 20 of the nonwoven web. After application of the abrasive particles, the nonwoven web is then agitated by mechanical means in order to promote settling of the abrasive particles between filaments of the nonwoven web. Due to the adherent nature of the uncured make coat 34 and the relatively large size of the abrasive particles 21 relative to the open spaces between filaments of the nonwoven web a substantial number of the abrasive particles bond to nonwoven web proximate to the first major web surface 20. This provides a non-uniform distribution or gradient of abrasive particles between the first major web surface 20 and the second major web surface 22 with a higher or maximum concentration of abrasive particles being bonded to the nonwoven web proximate the first major surface 20. After mechanical agitation, the abrasive particle coated nonwoven web is then passed through a curing station or forced air oven to cure the make coat 34. After curing the make coat, a second coating of binder or size coat 36 is applied with a coating device such as a spray station. The spray station preferably applies the size coat 36 to both the first major surface 20 and the second major surface 22 of nonwoven web 14. The quantity of binder applied in the make coat and size coat must be enough to adherently bond the abrasive particles 21 to the filaments of the nonwoven web 14 and also to adherently bond the filaments of the nonwoven web 14 one to the other. The quantity of binder applied in the size coat 36 should be limited such that it will not mask the abrasive particles 21. Once the size coat 36 is applied, the nonwoven web 14 is then passed through a second curing station such as a forced air oven, in order to cure the size coat.

After curing, backing 12 is then adhesively bonded or laminated to the second major surface 22 of the nonwoven web. The abrasive coated nonwoven web is then cut into the desired shape for abrasive article 10. Alternatively, the abrasive coated nonwoven web could first be cut into the desired shape followed by adhesive bonding or lamination of backing 12.

Nonwoven web

The nonwoven web 14 is preferably a continuous filament web such as described in Fitzer. In order to form a continuous filament web, a thermoplastic polymeric filament-forming material is heated to a molten state and extruded from an extrusion spinner which contains at least one row of openings to provide a bundle of free-falling filaments. The filaments are permitted to freely fall through an air space into a quench bath where they coil and undulate thereby setting up a degree of resistance to the flow of the molten filaments, causing the molten filaments to oscillate just above the bath surface. The spacing of the extrusion openings from which the filaments are formed is such that, as the molten filaments coil and undulate at the bath surface, adjacent filaments touch one another. The coiling and undulating filaments are still sufficiently tacky as this occurs, and where the filaments touch, most adhere to one another to cause autogenous bonding.

While it is still sufficiently plastic to be permanently deformed the nonwoven web is passed between smooth surface rollers which are positioned to provide a substantially flat-surfaced web. The nonwoven web is then removed from the quench bath and is passed through a drying station to remove residual quench liquid.

The filaments forming the nonwoven web typically have a diameter between about 5 to 50 mils (0.13 to 1.27 millimeters), but preferably have a diameter between about 10 to 20 mils (0.25 to 0.51 millimeters), and most preferably have a diameter between about 13 to 17 mils (0.33 to 0.43 millimeters). Typical nonwoven web thickness useful for the abrasive article according to the present invention will vary between about 6 to 50 millimeters, typically between about 12 to 25 millimeters, and most preferably between about 12 to 19 millimeters.

Alternatively, the nonwoven web 14 can be a staple fiber nonwoven web of the type described in Hoover et al.. A staple fiber web is formed of many randomly oriented flexible durable tough organic fibers. Fibers of the web are firmly bonded together at points where they intersect and contact one another by an organic binder thereby forming a open, porous, lofty nonwoven web. A staple fiber nonwoven web is readily formed on equipment such as that available under the trade designation "Rando Webber" commercially available from Rando Machine Company of Macedon, N.Y. or any other conventional carding process. Useful staple fiber nonwoven webs typically have a weight per unit area between about 25 to 400 grains/24 $in^2$ (105 to 1676 $g/m^2$), more preferably between about 100 to 230 grains/24 $in^2$ (419 to 964 $g/m^2$). Lesser weights per unit area will provide abrasive articles which may have shorter useful lives. The foregoing weights typically will provide a nonwoven web having a thickness between about 5 to 200 millimeters, typically between about 6 to 75 millimeters, and preferably between about 10 to 30 millimeters.

In order to be useful in an abrasive article according to the present invention a staple fiber web may require densification in order to increase its strength. Densification can be performed by simultaneously heating and compressing the staple fiber web. Compression of the web can be performed by applying pressure to the major surfaces of the nonwoven web using any suitable means, such as for example by passing the web between rollers placed in a heated oven, passing the web between heated rollers, or by compressing the web by placing a screen across a major surface of the nonwoven web while simultaneously heating the web. Once densified, binder may be applied in order to further strengthen the staple fiber nonwoven web.

The nonwoven web generally should have adequate strength to hold the abrasive particles sufficiently firmly in position such that when an abrasive article according to the present invention is placed in contact with a workpiece and is rotated the nonwoven web will move the abrasive particles relative to the workpiece causing the abrasive particles to abrade the workpiece.

Those skilled in the art will appreciate that the invention is not to be unduly limited to any particular method for the manufacture of nonwoven web 14.

Filament/Fiber Material

The filament forming material which is extruded to form a continuous filament nonwoven web may be of any thermoplastic polymeric material which can be extruded through extrusion orifices to form filaments. The thermoplastic material preferably has a high yield strength of at least 3000 psi to provide the necessary toughness for prolonged use as an abrasive article. A particularly useful polymeric material for forming the filaments of a continuous filament nonwoven web is polyamide such as polycaprolactam and polyhexamethylene adipamide (e.g., nylon 6 and nylon 6,6). A particularly preferred material is the polycaprolactam polymer available commercially under the trade designation "ULTRAMID B3" from BASF Corporation, Polymers Division, Mt. Olive, N.J. Other useful filament-forming polymeric materials include polyolefins (e.g., polypropylene and polyethylene), polyesters (e.g., polyethylene terephthalate), polycarbonate and the like.

Where the nonwoven web 14 is a staple fiber web of the type described in Hoover et al., identified above, satisfactory staple fibers may be of any synthetic material, such as nylon (e.g., polyhexamethylene adipamide, polycaprolactam), polyester (polyethylene terephthalate), polypropylene, acrylic, rayon, cellulose acetate, polyvinylidene chloride-vinyl chloride copolymers, vinyl chloride-acrylonitrile copolymers, which is capable of withstanding the temperatures at which the binder is cured without deterioration, and which provides the necessary toughness for prolonged use as an abrasive article. Staple fibers found satisfactory are preferably tensilized and crimped and are between about 20 to 110 mm in length, preferably between about 40 to 65 mm in length, and have a linear density ranging from between about 15 to 2000 denier and preferably between about 200 to 600 denier.

Binder

The preferred binder employed in the production of the claimed abrasive article has a liquid state to provide a coatable composition, yet it can be cured to form a tough, adherent material capable of adherently bonding the abrasive particles to the nonwoven web even under aggressive use conditions. Binders found satisfactory include phenol-formaldehyde, epoxy, polyurethane, urea-formaldehyde, various 100% convertible resins, water-based emulsions and dispersions, and other resins which are commonly utilized in making low density abrasive articles.

The quantity of binder will be sufficient to adherently bond the abrasive particles 21 throughout the nonwoven web 14 to provide a long-life abrasive article yet will be limited so that it will not mask the abrasive particles. Thus, as the size of the abrasive particle varies, some modification may be required in the amount of binder used. Besides binding the abrasive particles 21 to the surfaces of the filaments of the nonwoven web 14, the binder also provides for additional bonding of the filaments forming the nonwoven web one to another. While these filaments may have been autogenously bonded together during the web forming operation, they are still subject to separation, especially when large mechanical forces are applied to the abrasive article.

The presently preferred binder is a polyurethane-urea which may be prepared with certain isocyanate prepolymeric materials such as those sold under the trade designation "ADIPRENE" available from Uniroyal Chemical Company Inc. The isocyanate prepolymeric material may be cured with an active hydrogen compound such as polyols or polyamines. The reactive isocyanate groups of the isocyanate prepolymeric materials may be blocked with blocking agents such as ketoxime or phenol to give a liquid material which may be cured with an active hydrogen compound such as a polyol or a polyamine.

The preferred cured binder will have a tensile strength of at least 3000 psi, and an ultimate elongation of at least 180% and a Shore D hardness of at least 40. The uncured binder will cure with heating in a temperature range of 100° C. to 160° C. to produce cured binder having the requisite physical properties, yet they are initially liquid and have sufficient pot life to be used in the process described herein. The uncured, unblocked prepolymeric materials will have a nominal NCO content of between about 3% to 10%, a nominal viscosity at 30° C. of between about 6000 cps. to 30,000 cps. and a specific gravity at 25° C. of between about 1.03 to 1.15. The cured binder will typically have a tensile strength between about 3000 psi to 11,000 psi, and ultimate elongation between about 180% to 800% and a Shore D hardness value of between about 40 to 80. The binder applied prior to the addition of the abrasive particles is referred to as the make coat. A preferred composition of the make coat 34 comprises

- 39.9 parts of ketoxime-blocked poly(1,4-butylene glycol diisocyanate) (commercially available under the trade designation "ADIPRENE" BL-16 from Uniroyal Chemical Company Inc., Middlebury, Conn.);
- 13.8 parts of methylene dianiline solution which consists of 35 parts 4,4'methylene-bis aniline and 65 parts ethylene glycol monoethyl ether acetate;
- 0.8 parts glycidoxypropyltrimethoxy silane (commercially available as Z-6040 from Dow Corning Corporation, Midland, Mich.);
- 30.4 parts xylol solvent;
- 12.9 parts bentonite clay;
- 2.1 parts fumed silica (commercially available as "Cab-O-Sil" from Cabot Corporation, Cab-O-Sil Division, Tuscola, Ill.).

The make coat 34 is applied to the nonwoven web 14 to provide a dry coating with a weight between about 80 to 110 grains/24 $in^2$ (335 to 461 $g/m^2$), and preferably with a weight of about 100 grains/24 $in^2$ (419 $g/m^2$).

The binder applied subsequent to the addition of the abrasive particles is referred to as the size coat. A preferred composition for the size coat 36 comprises

- 58.8 parts of diisocyanate-functional urethane prepolymer (commercially available under the trade designation ADIPRENE BL-31 from Uniroyal Chemical Company Inc., Middlebury, Conn.);
- 25.3 parts of a curative consisting of 35 parts 4,4'-methylene-bis aniline and 65 parts of ethylene glycol monoethyl ether acetate;
- 0.9 parts of glycidoxypropyltrimethoxy silane coupling agent (commercially available as Z-6040 from Dow Corning Corporation, Midland, Mich.);
- 12.9 parts of xylol solvent;
- 2.1 parts lithium stearate powder lubricant.

The size coat 36 is applied to the nonwoven web 14 to provide a dry coating having a weight between about 80 to 200 grains/24 $in^2$ (335 to 838 $g/m^2$), preferably with a weight between about 100 to 140 grains/24 $in^2$ (419 to 587 $g/m^2$), and most preferably with a weight of about 120 grains/24 $in^2$ (503 $g/m^2$).

Abrasive particles

Abrasive particles 21 are adhered to the nonwoven web 14 to impart the a desired abrasive character to the abrasive article 10. The abrasive particles are preferably applied in a relatively uniform distribution across the first major surface 20 of the nonwoven web. The abrasive particles may be present within the finished article at a weight between about 200 to 1200 grains/24 $in^2$ (838 to 5028 $g/m^2$), preferably between about 400 to 800 grains/24 $in^2$ (1676 to 3352 $grm^2$) and most preferably about 600 grains/24 $in^2$ (2514 $g/m^2$). Abrasive particles vary from particle to particle in both size and shape. The abrasive particle size range useful for the present invention is between about grade 4 to grade 36.

Abrasive particles employed in the practice of the present invention preferably are made of a relatively soft mineral such as the mineral mullite. Mullite is an aluminosilicate with the chemical composition of 3 $Al_2O_3$:2 $SiO_2$ and contains by weight approximately 75% $Al_2O_3$ and approximately 25% $SiO_2$. Due to its high melting point, the major market for mullite is in refractories with the principal markets being steel, glass, and ceramics.

Mullite is considered to be relatively soft for an abrasive particle, having a Mohs hardness of between 6 and 7. By comparison, silicon carbide, a known hard synthetic abrasive material, has a Mohs hardness of about 9.5 and aluminum oxide has a Mohs hardness of about 9. The Mohs hardness scale indicates the relative hardness of a material. The scale ranges from 1 to 10, with 1 being the softest and 10 being the hardest. Inorganic abrasive particles can be generally divided into hard inorganic abrasive particles (e.g. having a Mohs hardness greater than 8) and soft inorganic abrasive particles (e.g. having a Mohs hardness of less than 8). Examples of hard inorganic abrasive particles include fused aluminum oxide, heat treated aluminum oxide, white fused aluminum oxide, ceramic aluminum oxide such as those commercially available under the trade designation "CUBITRON" (available from Minnesota Mining and Manufacturing Company, St. Paul, Minn.), and black silicon carbide. Examples of soft inorganic particles include silica, iron oxide, chromia, ceria, zirconia, titania, silicates, and tin oxide. Still other examples of soft abrasive particles include metal carbonates, silica, silicates, metal sulfates, gypsum, aluminum trihydrate, graphite, metal oxides, metal sulfites, metal particles, and glass particles.

As a naturally occurring mineral, mullite is rare and is not economically mined. As such, industrial quantities of mullite are supplied by synthetic manufacture. Fused mullite is produced using either a Higgins furnace or a tilt pour electric arc furnace. The essential ingredients for production of fused mullite are high purity (low iron) silica and/or zircon sand and Bayer process alumina. Synthetically manufactured fused mullite is available under the trade designation "DURAMUL" from Washington Mills Electro Minerals Corporation of North Grafton, Mass. "DURAMUL" fused mullite is produced by the electric furnace fusion of Bayer process alumina and high purity silica. "DURAMUL" fused mullite contains approximately 75.00% $Al_2O_3$, 24.70% $SiO_2$, and 0.30% $Na_2O$ by weight. Fused mullite is also available from Elfusa Ltda, Sao Joa da Boa Vista, Brazil.

Mullite may be produced synthetically in three forms: sintered, fused, and fused zirconia. Sintered and fused mullite have distinct properties from one another. Fused mullite has large crystals which are "blade like" in shape whereas crystals in sintered mullite are smaller and tabular in shape. Due to its orthorhombic crystalline structure, fused mullite easily breaks into elongate or "blade like" particles. Therefore fused mullite abrasive particles typically contain sharp edges and corners which provide the abrasive particles with multiple cutting points.

Mullite may be crushed or broken using any suitable means, such as a hammer or ball mill, to form abrasive particles. Any method for crushing the mullite can be used and the term crushing is used to include all such methods. The crushed mullite particles are then classified according to particle size using American National Standards Institute specifications for grading abrasive minerals.

Prior to use in an abrasive article the crushed mullite must be separated according to size. The screens used in sizing abrasive particles measure only two dimensions of the abrasive particle. Hence, abrasive particles that pass through a certain screen (e.g., grade 20) pass such because two of the dimensions of the three dimensional abrasive particle fit within the size range of the screen. However an abrasive particle, because it is three dimensional, may be relatively short or long in the unsized dimension even though it passes through a particular grade screen. Thus, abrasive particles graded by this process vary in shape from particle to particle with some being elongate, or significantly longer in the unsized dimension, and some having more equal lengths in all dimensions.

Due to the fracturing properties of fused mullite and the inherent limitations in a two-dimensional abrasive particle sizing process, graded mullite abrasive particles vary considerably in both size and shape from particle to particle. The abrasive particles useful for the present invention are typically provided in multi-grade particle mixtures. For example, fused mullite particles commercially available under the trade designation "DURAMUL" available from Washington Mills Electro Minerals Corporation, North Grafton, Mass. are provided in multi-grade mixtures such as for example 8/10, 8/12, 8/16, 10/36, and 14/40.

Although not wanting to be bound by any theory at this time, it is hypothesized that the fracturing properties and soft nature of mullite may account for its unexpectedly high cut rate as an abrasive particle. Specifically, the force imparted to the mullite particles during the abrading process may cause at least some of the relatively soft mullite particles to fracture, thereby generating new, sharp cutting surfaces.

Backing

The backing 12 used in the present invention is attached to the second major surface 22 of nonwoven web 14. Backing 12 provides means for attaching abrasive article 10 to a motorized abrading device such as a right angle grinder or electric drill. Backing 12 is preferably a fabric suitable for use in a so called "hook and loop" mechanical fastener system. In such a system the back the backing comprises a fabric with a multiplicity of loops 29 projecting from it. The loops are suitable for being held and driven by hooks projecting from a support surface of a pad adapted to be machine driven by a motorized abrading device. Alternatively, the backing may comprise a sheet with a multiplicity of hooks designed to engage with loops provided on the surface of a pad adapted to be machine driven by a motorized abrading device. The backing 12 may also comprise a pressure sensitive adhesive sheet of a type suitable for adhesive attachment to a support surface of a pad adapted to be machine driven by a motorized abrading device. Abrasive article 10 may alternatively be provided with a center arbor hole for attachment to a motorized abrading device.

Modification

The abrasive articles of the present invention may be modified in other ways without departing from the scope of the claims. For example, commonly known additive materials may be employed in the binder coating such as metal working lubricants (e.g., greases, oils, and metal stearates). Such additives are typically added during the size coating operation so as not to interfere with adhesion to the filaments.

The abrasive articles of the present invention may be provided in any of a variety of shapes as typically encountered for low-density abrasive articles. For example, they may be provided as disc-shaped abrasive articles. Other shapes are also contemplated. The preferred abrasive article of the present invention is in a disc-shaped form, typically provided with diameters between about 2 inches to 9 inches (5.1 to 22.9 cm).

The abrasive article of the present invention may be laminated to other layers to provide a modified abrasive article. For example, the abrasive article may be laminated to a foam or sponge layer to provide dual function or to provide a cushioning layer. Any of a variety of mounting devices or handles may also be applied to the abrasive article to provide a abrasive article which may have a removable or permanently attached handle.

The features of the invention are further illustrated in the following non-limiting example.

MATERIALS

In the Examples below, materials are identified according to certain abbreviations or trade designations.

"DURAMUL" is the trade designation of mullite particles available from Washington Mills Electro Minerals Corporation, North Grafton, Mass.

"DURALUM" is the trade designation of blocky $Al_2O_3$ abrasive particles available from Washington Mills Electro Minerals Corporation, North Grafton, Mass.

Elfusa SiC silicon carbide abrasive particles, available from Elfusa Ltda, Sao Joa da Boa Vista, Brazil.

Elfusa mullite mullite particles, available from Elfusa Ltda, Sao Joao da Boa Vista, Brazil.

3M $Al_2O_3$ aluminum oxide abrasive particles, available from Minnesota Mining and Manufacturing Company, St. Paul, Minn.

3M SiC silicon carbide abrasive particles, available from Minnesota Mining and Manufacturing Company, St. Paul, Minn.

"CUBITRON" 201 is the trade designation for ceramic aluminum oxide abrasive particles, available from Minnesota Mining and Manufacturing Company, St. Paul, Minn.

TEST METHOD

The following test procedure was employed in evaluating the articles of the Examples.

Slide action test

This test was developed to provide a determination of end-use abrasive performance under severe conditions, and involves reciprocating a test workpiece in contact with a rotating abrasive disc. A loop fabric was attached via a hot-melt adhesive to the back side of the nonwoven web of each abrasive article to be tested. A 7-inch (17.8 cm) diameter disc of the material to be evaluated was attached to a molded plastic back-up pad having hooks designed to engage the loops of the loop fabric of 6.75 inches (17.1 cm) diameter and a maximum thickness of 0.4 inch (1.0 cm). This assembly was then installed on a hydraulic grinder and adjusted to operate at 5000 rpm. A 3 inch (7.6 cm) wide by 15 inches (38.1 cm) long by 0.5 inch (1.27 cm) thick test workpiece of unhardened 1018 carbon steel was secured in a hydraulically actuated reciprocating means designed to move the workpiece through an approximate 10-inch (25.4 cm) stroke parallel to its long axis at a rate to move a full cycle every 4 seconds. The grinder and the reciprocating means were activated and the two were urged together under a load of 14 lb. (6.3 kg). Each test was run for 4 minutes, after which the workpiece was weighed, the disc was weighed, and the surface finish of the tested workpiece was measured using a stylus-type profilometer.

EXAMPLE 1

A nonwoven web was made similarly to that of Example 1 of Fitzer. Polycaprolactam polymer (nylon 6, available commercially under the trade designation "ULTRAMID B3" from BASF Corporation, Polymers Division of Mt. Olive, N.J.) was extruded at a pressure of 2800 psi through a 60-inch long (1.52 meter) spinner having about 2890 openings arranged in eight equal rows spaced 0.2 inches (5.1 mm) apart, each opening having a diameter of 0.016 inches (0.406 mm). The spinneret was heated to about 248° C. and positioned about 12 inches (30.48 cm) above the surface of a quench bath which was continuously filled and flushed with 21° C. water at the rate of about 0.5 gallon per minute (about 2 liters/minute). Filaments extruded from the spinner were permitted to fall into the quench bath where they undulated and coiled between four inch (10.16 cm) diameter, 60-inch (1.52 m) long smooth-surfaced rolls. Both rolls were positioned in the bath with their axes of rotation about 2 inches (5.1 cm) below the surface of the bath, and the rolls were rotated in opposite directions at the rate of about 15 feet/minute (4.57 m/minute) surface speed. The rolls were spaced to lightly compress the surfaces of the resultant extruded nonwoven web, providing a flattened but not densified surface on both sides. The polymer was extruded at a rate of about 800 lb./hr (364 kg/hr), producing a 59 inch wide, 0.66 inch thick (1.50 m wide x 16.8 mm thick) nonwoven web having 8 rows of coiled, undulated filaments. The resulting nonwoven web weighed about 900 g/m$^2$ and had a void volume of about 95%. The filament diameter averaged between 13 and 17 mils (0.33 and 0.44 mm). The nonwoven web was carried from the quench bath around one of the rolls and excess water was removed from the nonwoven web by drying with a room temperature (about 23° C.) air blast.

The dried nonwoven web thus formed was later converted into an abrasive article by applying a make coat, a multiplicity of abrasive particles, and a size coat. The make coat was applied via a 2-roll coater and contained the ingredients shown in Table 1. Following the application of the make coat to achieve about 96 grains/24 in$^2$ (402 g/m$^2$) dry add-on, 8/12 grade "DURAMUL" fused mullite abrasive particles (Washington Mills Electro Minerals Corporation, North Grafton, Mass.) were then applied via a drop coater to achieve an abrasive particle coating weight of 609 grains/24 in$^2$. The nonwoven web was agitated to encourage penetration of the abrasive particles into the interstitial spaces of the nonwoven web. The composition was then heated in an oven for 6 minutes at 160° C. in order to cure the make coat.

TABLE 1

| Component | Parts |
|---|---|
| ketoxime-blocked poly(1,4-butylene glycol diisocyanate)[1] | 39.9 |
| methylene dianiline solution[2] | 13.8 |
| glycidoxypropyltrimethoxy silane[3] | 0.8 |
| xylol solvent | 30.4 |
| bentonite clay | 12.9 |
| fumed silica[4] | 2.1 |

[1]polydiisocyanate having a moleuclar weight of about 1500 commercially available under the trade designation "ADIPRENE" BL-16 from Uniroyal Chemical Company, Inc., Middlebury, CT.
[2]a curative solution of 35 parts 4,4'-methylene-bis aniline and 65 parts ethylene glycol monoethyl ether acetate.
[3]silane coupling agent, available as "Z-6040" from Dow Corning Corporation, Midland, MI.
[4]viscosity modifier, available as "Cab-O-Sil" from Cabot Corporation, Cab-O-Sil Division, Tuscola, Illinois.

A size coat having the ingredients shown in Table 2 was then sprayed on the abrasive particle coated side of the composition. The composition was then heated in an oven for 6 minutes at 160° C. The composition was inverted and the other side sprayed with an identical amount of the size coating and heated in an oven for 6 minutes at 160° C. The total size coat dry add-on was about 120 grains/24 in$^2$ (503 g/m$^2$). The resulting composition was then converted into a disc shaped abrasive article for testing. The performance of this abrasive article was then measured using the Slide Action Test detailed below.

TABLE 2

| Component | Parts |
|---|---|
| diisocyanate-functional urethane prepolymer[5] | 58.8 |
| methylene dianiline solution[6] | 25.3 |
| glycidoxypropyltrimethoxy silane[7] | 0.9 |
| xylol solvent | 12.9 |
| lithium stearate powder lubricant | 2.1 |

Note: Fumed Silica deleted from this table.
[5]diisocyanate-functional urethane prepolymer blocked by adding 14.8% 2-butanoneoxime and 11.1% 2-ethoxyethanol acetate, commercially available under the trade designation "ADIPRENE" BL-31 from Uniroyal Chemical Company, Inc., Middlebury, CT.
[6]a curative solution of 35 parts 4,4'-methylene-bis aniline and 65 parts ethylene glycolmonoethyl ether acetate.
[7]silane coupling agent, available as "Z-6040" from Dow Corning Corporation, Midland, MI.

EXAMPLE 2

This abrasive article was prepared using the procedure described for Example 1 except that 10/36 grade "DURAMUL" fused mullite abrasive particles were applied to achieve an abrasive particle coating weight of 439 grains/24 in$^2$. The performance of this abrasive article was measured using the Slide Action Test.

EXAMPLE 3

This abrasive article was prepared using the procedure described for Example 1 except that 16/35 grade "DURAMUL" fused mullite abrasive particles were applied to achieve an abrasive particle coating weight of 470 grains/24 in$^2$. The performance of this abrasive article was measured using the Slide Action Test.

EXAMPLE 4

This abrasive article was prepared using the procedure described for Example 1 except that 35/70 grade "DURAMUL" fused mullite abrasive particles were applied to achieve an abrasive particle coating weight of 530 grains/24 in$^2$. The performance of this abrasive article was measured using the Slide Action Test.

EXAMPLE 5

This abrasive article was prepared using the procedure described for Example 1 except that 40/100 grade "DURAMUL" fused mullite abrasive particles were applied to achieve an abrasive particle coating weight of 528 grains/24 in$^2$. The performance of this abrasive article was measured using the Slide Action Test.

Comparative Example A

This abrasive article was prepared using the procedure described for Example 1 except that 10 grade "DURALUM" blocky $Al_2O_3$ abrasive particles were applied to achieve an abrasive particle coating weight of 708 grains/24 in$^2$. The performance of this abrasive article was measured using the Slide Action Test.

Comparative Example B

This abrasive article was prepared using the procedure described for Example 1 except that 16 grade "DURALUM" blocky $Al_2O_3$ abrasive particles were applied to achieve an abrasive particle coating weight of 591 grains/24 in$^2$. The performance of this abrasive article was measured using the Slide Action Test.

Comparative Example C

This abrasive article was prepared using the procedure described for Example 1 except that 24 grade "DURALUM" blocky $Al_2O_3$ abrasive particles were applied to achieve an abrasive particle coating weight of 657 grains/24 in$^2$. The performance of this abrasive article was measured using the Slide Action Test.

Comparative Example D

This abrasive article was prepared using the procedure described for Example 1 except that 36 grade "DURALUM" blocky $Al_2O_3$ abrasive particles were applied to achieve an abrasive particle coating weight of 736 grains/24 in$^2$. The performance of this abrasive article was measured using the Slide Action Test.

Comparative Example E

This abrasive article is a conventional coated abrasive disc having a particle coating weight of 188 grains/24 in$^2$ of "CUBITRON" 201 abrasive particles. The abrasive disc is commercially available under the trade designation REGAL 983C from Minnesota Mining and Manufacturing Company, St. Paul, Minn. The performance of this abrasive article was measured using the Slide Action Test.

Comparative Example F

This abrasive article was prepared using the procedure described for Example 1 except that 16 grade Elfusa silicon carbide abrasive particles were applied to achieve an abrasive particle coating weight of 451 grains/24 in$^2$. The performance of this abrasive article was measured using the Slide Action Test.

Comparative Example G

This abrasive article was prepared using the procedure described for Example 1 except that 36 grade 3M silicon carbide abrasive particles were applied to achieve an abrasive particle coating weight of 575 grains/24 in$^2$. The performance of this abrasive article was measured using the Slide Action Test.

TABLE 3

| Example | Particle Type | Grade | Disc wt (g) | Particle wt. (grains/24 in$^2$) | Cut (g) | Wear (g) | Finish ($\mu$m) |
|---|---|---|---|---|---|---|---|
| 1 | DURAMUL fused mullite | 8/12 | 95 | 609 | 55.4 | 3.7 | 50 |
| 2 | DURAMUL fused mullite | 10/36 | 105 | 439 | 34.7 | 2.0 | 35 |
| 3 | DURAMUL fused mullite | 16/35 | 104 | 470 | 29.8 | 1.4 | 37 |

TABLE 3-continued

| Example | Particle Type | Grade | Disc wt (g) | Particle wt. (grains/24 in$^2$) | Cut (g) | Wear (g) | Finish ($\mu$m) |
|---|---|---|---|---|---|---|---|
| 4 | DURAMUL fused mullite | 35/70 | 97 | 530 | 4.7 | 0.3 | 25 |
| 5 | DURAMUL fused mullite | 40/100 | 98 | 528 | 4.4 | 0.1 | 23 |
| Comparative Example A | DURALUM blocky $Al_2O_3$ | 10 | 140 | 708 | 44.4 | 10.8 | 87 |
| Comparative Example B | DURALUM blocky $Al_2O_3$ | 16 | 123 | 591 | 34.5 | 3.3 | 32 |
| Comparative Example C | DURALUM blocky $Al_2O_3$ | 24 | 131 | 657 | 28.5 | 1.7 | 32 |
| Comparative Example D | DURALUM blocky $Al_2O_3$ | 36 | 134 | 736 | 29.0 | 1.1 | 26 |

As illustrated in Table 3 a product of the present invention Example 1 had a total cut on carbon steel that was greater than any of the other abrasive articles tested. Specifically, Example 1, employing 8/12 grade mullite as the abrasive particle had a higher cut than Comparative Example A, an abrasive article employing 10 grade blocky $Al_2O_3$ as the abrasive particle.

TABLE 4

| Example | Particle Type | Grade | Disc wt (g) | Particle wt. (grains/24 in$^2$) | Cut (g) | Wear (g) | Finish ($\mu$m) |
|---|---|---|---|---|---|---|---|
| 1 | DURAMUL fused mullite | 8/12 | 95 | 609 | 55.4 | 3.7 | 50 |
| Comparative Example E | CUBITRON 201 | 36 | 59 | 188 | 64.0 | 1.2 | 37 |

Table 4 compares the cut of a low density abrasive article according to the present invention (Example 1) with a premium coated abrasive article (Comparative Example E). Comparative Example E utilizes "CUBITRON" 201 abrasive particles having a Mohs hardness of about 9. Example 1, which utilizes 8/12 grade fused mullite abrasive particles, has a cut rate that compares favorably with the cut rate of the premium coated abrasive article.

TABLE 5

| Example | Particle Type | Grade | Disc wt (g) | Particle wt. (grains/24 in$^2$) | Cut (g) | Wear (g) | Finish ($\mu$m) |
|---|---|---|---|---|---|---|---|
| 1 | DURAMUL fused mullite | 8/12 | 95 | 609 | 55.4 | 3.7 | 50 |
| Comparative Example F | ELFUSA SiC | 16 | 112 | 451 | 7.8 | 2.7 | 28 |
| Comparative Example G | 3M SiC | 36 | 129 | 575 | 4.4 | 2.4 | 20 |

Table 5 compares the cut of a low density abrasive article according to the present invention (Example 1) with a low density abrasive articles utilizing silicon carbide abrasive particles (Comparative Examples F and G). The low-density abrasive article according to the present invention (Example 1) has a cut rate on carbon steel that is significantly greater than low-density abrasive articles made with Silicon Carbide abrasive particles (Comparative Examples E and F).

The tests and test results described above are intended solely to be illustrative, rather than predictive, and variations in the testing procedure can be expected to yield different results.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A low-density abrasive article comprising:

an open, porous, lofty, nonwoven web having a relatively planar first major web surface and a relatively planar second major web surface;

a binder; and a multiplicity of fused mullite abrasive particles non-uniformly distributed throughout said nonwoven web and bonded to said nonwoven web by said binder wherein the abrasive particles each have a particle size between about grade 4 to grade 36.

2. An abrasive article according to claim 1 wherein said nonwoven web is a continuous filament web comprising a multitude of continuous undulated interengaged thermoplastic polymeric filaments autogenously bonded at points of mutual contact.

3. An abrasive article according to claim 2 wherein said thermoplastic polymeric filaments are polyamnide, polyolefin, polyester, and polycarbonate.

4. An abrasive article according to claim 2 wherein said thermoplastic polymeric filaments are polycaprolactam.

5. An abrasive article according to claim 2 wherein said filaments have a diameter between about 5 to 50 mils.

6. An abrasive article according to claim 2 wherein said filaments have a diameter between about 10 to 20 mils.

7. An abrasive article according to claim 1 wherein said nonwoven web is a staple fiber web comprising a multitude of randomly oriented fibers adhesively bonded together at points of mutual contact.

8. An abrasive article according to claim 7, wherein said fibers are crimped staple fibers, each having a linear density between about 15 to 2000 denier and a length between about 20 to 110 millimeters.

9. An abrasive article according to claim 7, wherein the fibers of the nonwoven web are selected from the group consisting of polyester, nylon, polypropylene, acrylic, rayon, cellulose acetate, polyvinylidene chloride-vinyl chloride copolymers, vinyl chloride-acrylonitrile copolymers, and combinations thereof.

10. An abrasive article according to claim 1 wherein said abrasive particles comprise fused mullite having by weight about 75% $Al_2O_3$ and about 25% $SiO_2$.

11. An abrasive article according to claim 1 having a higher concentration of said abrasive particles bonded proximate said first major surface.

12. An abrasive article according to claim 1 wherein said abrasive article provides a cut on 1018 carbon steel of greater than about 30 grams.

13. An abrasive article according to claim 1 wherein said abrasive article provides a cut on 1018 carbon steel of greater than about 40 grams.

14. An abrasive article according to claim 1 wherein said abrasive article provides a cut on 1018 carbon steel of greater than about 50 grams.

15. An abrasive article according to claim 1 wherein said abrasive particles each have a particle size between about grade 4 to 12.

16. An abrasive article according to claim 1 adapted to be attached to a motorized abrading device.

17. An abrasive article according to claim 1 wherein said binder is selected from the group consisting of polyurethane, polyurethane-urea, epoxy, urea-formaldehyde, phenol-formaldehyde and combinations thereof.

18. An abrasive article according to claim 1 wherein said binder comprises a make coat and a size coat wherein said make coat is applied to said nonwoven web at a dry coating weight between about 80 to 110 grains/24 $in^2$ and wherein said size coat is applied to said nonwoven web at a dry coating weight between about 80 to 200 grains/24 $in^2$.

19. An abrasive article according to claim 1 wherein said abrasive particles are applied to said nonwoven web at a coating weight between about 200 to 1200 grains/24 $in^2$.

20. A method for removing material from the surface of a workpiece comprising the steps of:

(a) manually pressing an abrasive article according to claim 1 against the workpiece;

(b) rapidly moving said abrasive article relative to said workpiece while maintaining pressure between said abrasive article and said workpiece surface.

21. The method according to claim 20 wherein said abrasive article is in the shape of a disc having a center axis and moving the abrasive article relative to the workpiece is accomplished by rotating said abrasive article about said center axis.

22. The method according to claim 20 wherein the material removed from the workpiece is carbon steel.

23. The method according to claim 20 wherein the material removed from the workpiece is a polymeric surface coating.

24. A low-density abrasive article comprising:

an open, porous, lofty, nonwoven web;

a binder; and a multiplicity of abrasive particles bonded to said nonwoven web by said binder wherein the abrasive particles consist essentially of fused mullite having a particle size between about grade 4 to grade 36.

* * * * *